US005524884A

United States Patent [19]

Haines

[11] Patent Number: 5,524,884

[45] Date of Patent: Jun. 11, 1996

[54] STRIKING IMPLEMENTS

[75] Inventor: Robert C. Haines, Fenay Bridge Huddersfield, England

[73] Assignee: Dunlop Limited, London, England

[21] Appl. No.: 241,351

[22] Filed: May 11, 1994

Related U.S. Application Data

[63] Continuation-in-part of Ser. No. 127,418, Sep. 27, 1993, abandoned, which is a continuation of Ser. No. 915,417, Jul. 17, 1992, abandoned.

[30] Foreign Application Priority Data

Jul. 18, 1991 [GB] United Kingdom ..... 9115559

[51] Int. Cl.[6] ..... A63B 59/00

[52] U.S. Cl. ..... 273/67 R; 273/67 DA; 273/73 J; 273/72 R; 273/67 A

[58] Field of Search ..... 273/72 R, 72 A, 273/67 A, 73, 80 R, 75, 77 R, 67 R, 81 R, 80 B, 80.4, 80.9, 67 DA

[56] References Cited

U.S. PATENT DOCUMENTS

| | | | |
|---|---|---|---|
| 1,828,109 | 10/1931 | Fox . | |
| 3,833,218 | 9/1974 | Frankel et al. . | |
| 4,082,273 | 4/1978 | Ellzey . | |
| 4,194,738 | 3/1980 | Inoue . | |
| 4,340,226 | 7/1982 | Haines . | |
| 4,367,871 | 1/1985 | Schiefer . | |
| 4,600,194 | 7/1986 | Donnelly . | |
| 4,609,198 | 9/1986 | Tarr . | |
| 4,627,635 | 10/1986 | Koleda . | |
| 4,660,832 | 4/1987 | Shomo | 273/73 J |
| 4,736,949 | 4/1988 | Muroi . | |
| 4,746,119 | 5/1988 | Jeanrot . | |
| 4,826,167 | 5/1989 | Lo . | |
| 4,875,679 | 10/1989 | Movilliat et al. . | |
| 4,906,002 | 3/1990 | Goffney . | |
| 5,071,125 | 12/1991 | Shen | 273/73 R |
| 5,131,652 | 7/1992 | Peng | 273/73 |
| 5,135,223 | 8/1992 | You | 273/73 J |

FOREIGN PATENT DOCUMENTS

| | | |
|---|---|---|
| 221688 | 10/1986 | European Pat. Off. . |
| 3139006A | 4/1983 | Germany . |
| 83509A | 11/1989 | Italy . |
| 478008 | 7/1936 | United Kingdom . |
| 452607 | 8/1936 | United Kingdom . |
| 1600869 | 10/1981 | United Kingdom . |
| 2163963 | 8/1985 | United Kingdom . |
| 2149311 | 2/1987 | United Kingdom . |
| 2230458 | 10/1990 | United Kingdom . |
| 04698 | 6/1989 | WIPO . |
| 9005567 | 11/1989 | WIPO . |
| 9200781 | 11/1992 | WIPO . |

*Primary Examiner*—Mark S. Graham
*Attorney, Agent, or Firm*—Lorusso & Loud

[57] ABSTRACT

A striking implement comprises a handle portion and a striking portion, in which the striking implement is discontinuous in that it comprises two parts one part including the striking portion and the other part including the handle portion or a part thereof, the said two parts having complementary hollow formations which are assembled to overlap axially with a vibration-damping material interposed between and bonded to said formations, whereby the two parts are inseparably connected together but the vibration-damping material mechanically isolates one from the other, i.e. there is no direct contact between the two parts.

16 Claims, 3 Drawing Sheets

STRIKING IMPLEMENTS

This is a continuation-in-part of application Ser. No. 08/127,418 filed on Sep. 27, 1993 abandoned, which is a continuation of 07/915,417 filed on Jul. 17, 1992, abandoned.

This invention relates to a handheld striking implement which includes a vibration-damping element isolating the portion which is held from the portion used for striking.

Although the present invention will be described with particular reference to a games racket or a cricket bat it is not to be construed as limited thereto as it is applicable equally to other striking implements such as sports equipment e.g. hockey sticks, golf clubs, baseball bats, hurley sticks, polo sticks, croquet mallets, and also batons, truncheons and shillelaghs.

The present invention provides a striking implement which comprises a handle portion and a striking portion, in which the striking implement is discontinuous in that it comprises two parts one part including the striking portion and the other part including at least a part of the handle portion, the said two parts having complementary hollow formations which are assembled to overlap axially with a vibration-damping material interposed between and bonded to said formations in mutually perpendicular planes parallel to the longitudinal axis of the implement, such that the two parts are entirely free of direct contact with each other but are inseparably joined together.

Preferably the complementary formations assemble so as to constitute a substantially identical cross-section to that of the remainder of the handle portion. Examples of complementary formations are:

(i) two, three or more fingers which interdigitate when assembled, and (ii) a pin and socket.

The axial overlap of the complementary formations means that the confronting faces extend in planes angled to each other and substantially perpendicular to each other. Where the complementary formations are substantially identical but merely rotated through 90° in the final assembly it is possible and convenient to mould in one piece hollow handle portions with formations, cut through the formations, rotate one of the handle portions 90° and then assemble the complementary formations. The assembly must be suitably jigged to align the components prior to the vibration-damping material being injected to fill the gap between the said complementary formations.

The vibration-damping material may suitably be a thermosetting or a thermoplastics material and especially an injectable material, for example a polyurethane resin. A suitable material may be based upon an elastomeric material compounded to produce the properties of a vibration-damping material.

A preferred polyurethane resin comprises an injectable thermosetting elastomeric material particularly in the form of a two-part, curable polyurethane which is mixed in liquid form and can therefore be readily injected and subsequently cures in situ. Such a material is available from Compounding Ingredients Limited as CILCAST 101 (which is cured by the addition of CILCURE B). The words CILCAST and CILCURE are Registered Trade Marks. (The hardness and resilience of the vibration-damping materials are measured according to British Standards (B.S.) tests which are internationally available and familiar to the skilled artisan). Such a material has the properties desirable for the vibration-damping material of the present invention being of a hardness greater than 60° SHORE A measured according to BS 2782 Part 3 "Indentation Hardness by Durometer (Shore A)" and resilience below 20% when measured according to BS 903 Part A8 Method B "Method for Rebound Resilience". More preferably the vibration-damping material has a hardness in the range 70° to 95° SHORE A measured according to BS 2782 Part 3 "Indentation Hardness by Durometer (Shore A)", the preferable resilience for the vibration-damping material being in the range 5 to 15% measured according to BS 903 Part A8 Method B "Method for Rebound Resilience".

Preferably the vibration-damping material is self-bonding to the complementary formations of the two parts of the striking implement i.e. no separate adhesive is required. The aforementioned two-part curable polyurethanes have this desirable property.

Preferably the handle portion includes only one discontinuity according to the present invention but the handle portion itself may be joined to the striking portion rather than being integral therewith.

The present invention is particularly applicable for use in a cricket bat where it is important for the handle to be light, strong and able to absorb at least some of the shock received when the striking portion (i.e. the blade) strikes a cricket ball. Preferably the part which includes the handle portion is designed so that the formations are substantially in a plane perpendicular to the face of the striking portion (blade) and thus the formations of the part which includes the blade are in a plane substantially parallel to the face of the blade. This arrangement will improve shock absorbency of the final product.

Particularly where the formation of one part consists of 2 or more fingers which interdigitate with the corresponding 2 or more fingers of the other part it may be preferable to provide a web between the fingers of one said part to reduce bending of the formations when the implement is used for striking and thus to reduce the strain imposed on the bond between the complementary formations. To take advantage of this potential improvement the web should be provided between the formations, the free ends of which will be nearer to the striking portion when the striking implement is in use.

Preferred materials for the handle portion are of fibres e.g. of carbon or glass impregnated with a thermosetting or thermoplastics resin. Such compositions can be moulded to give hollow, and thus light, strong handle portions. Particularly for striking implements where there is a high degree of shock in use, e.g. a cricket bat or hockey stick, the fibres may be of material with increased shock absorbency properties e.g. aramid or polyethylene fibres.

The present invention will be illustrated merely by way of examples in the following description and with reference to the accompanying drawings in which.

Figure 1:
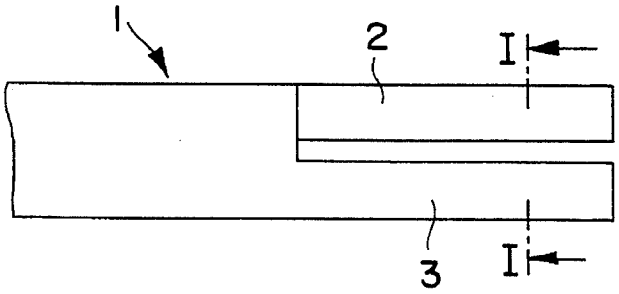
FIG. 1 is a side elevation of part of a handle portion with two fingers according to one embodiment of the present invention.
Figure 2:
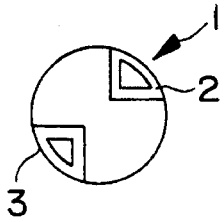
FIG. 2 is a sectional view along the line I—I of FIG. 1.
Figure 3:
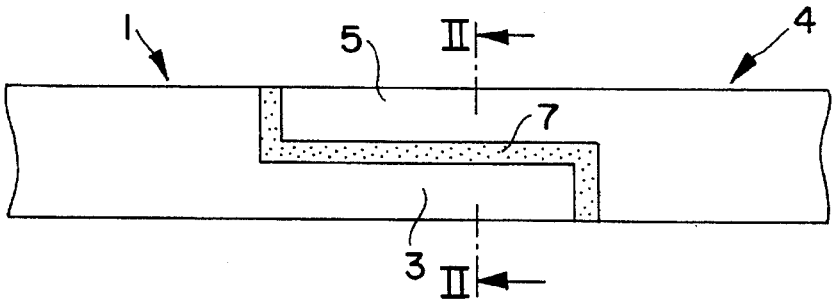
FIG. 3 is a side elevation of the part handle portion of FIG. 1 assembled with and bonded to its complementary part handle portion.
Figure 4:
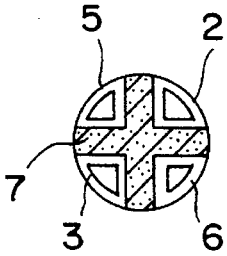
FIG. 4 is a sectional view along the line II—II of FIG. 3.
Figure 5:
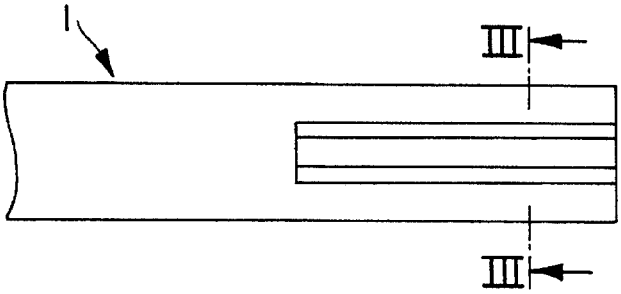
FIG. 5 is a side elevation of part of a handle portion with three fingers according to a second embodiment of the present invention.
Figure 6:
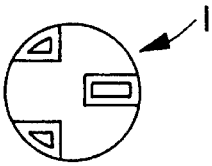
FIG. 6 is a sectional view along the line III—III of FIG. 5.
Figure 7:
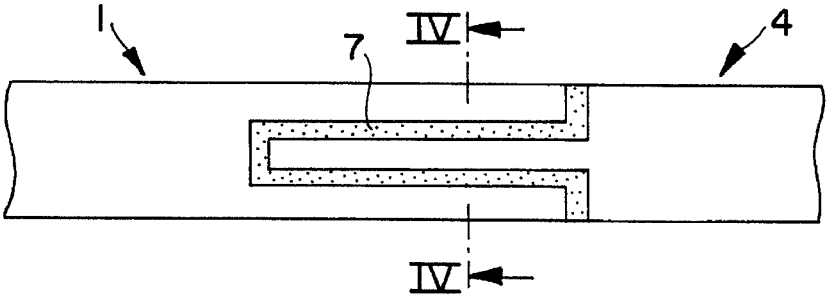
FIG. 7 is a side elevation of the part handle portion of FIG. 5 assembled with and bonded to the complementary handle portion.
Figure 8:
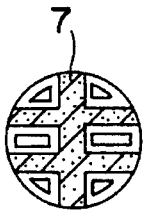
FIG. 8 is a sectional view along the line IV—IV of FIG. 7.

Referring to FIGS. 1, 2, 3 and 4 a part handle portion 1 has hollow formations (fingers) 2 and 3. The part handle portion 1 is hollow and made by wrapping layers of resin impregnated fibre in fabric or 'warp sheet' form around an inflation tube and then moulding under heat and internal pressure, as is well known to those skilled in the art of making hollow articles from polymer composite materials. Alternatively the inflation tube may be replaced by a plastic material capable of expanding under the action of heat to produce the necessary internal consolidating pressure. Fibre alignment of the wrapping layers is chosen to produce the desirable directional strength in the handle portion, and the fibre type may be chosen to produce desirable properties of enhanced shock absorbency over and above that provided by the vibration-damping material interposed between the complementary formations. Such fibres with good shock absorbency are glass fibres, aramid fibres and polyethylene fibres, and such fibres may be used in combination with each other or with carbon fibres to achieve the desirable properties. A part hollow handle portion 4 is made in the same way and has hollow formations 5 and 6 (which lies behind formation 3 in FIG. 3). The complementary formations (fingers) of these two part handle portions are assembled so as to interdigitate and vibration-damping material 7 is injected between the said formations. When the vibration-damping material 7 sets it bonds to the formations. Thus the part handle portions are mechanically isolated (i.e. there being no direct contact between them) but strongly bonded and thereby inseparably joined together by the vibration-damping material. Such an assembly may be used e.g. as part of a games racket.

Referring to FIGS. 5 to 8, the construction is of a very similar principle to that shown in FIGS. 1 to 4 but uses instead complementary hollow formations of three fingers each.

Figure 9:
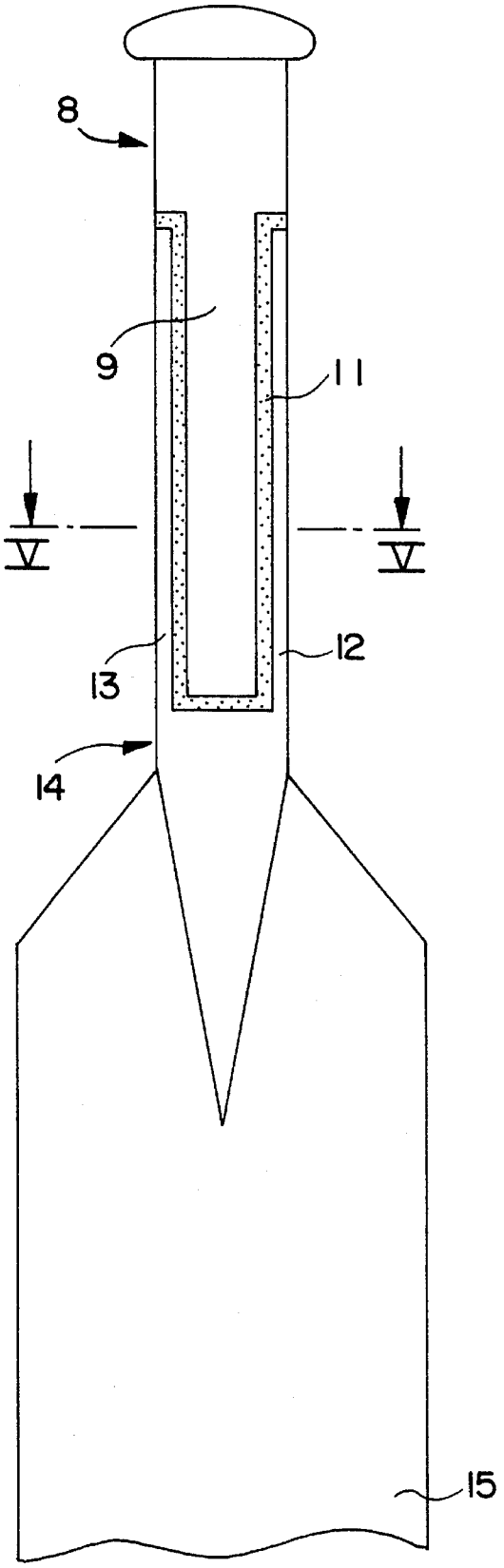
FIG. 9 is a front elevation of a cricket bat according to a further embodiment of the present invention.
Figure 10:
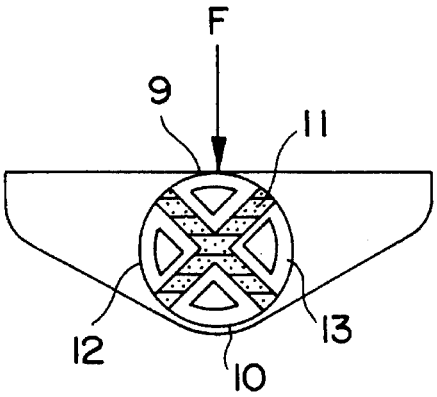
FIG. 10 is a sectional view along the line V—V of FIG. 9.

Referring to FIGS. 9 and 10, a cricket bat which incorporates a further embodiment of the present invention consists of a part handle portion 8 with formations 9, 10 assembled with and bonded via a vibration-damping material 11 to complementary formations 12, 13 of part handle portion 14. The handle assembly is hollow and of consolidated resin impregnated fibre composite and is bonded to a wooden blade 15.

The main direction in which a cricket ball will strike is shown by the arrow F in FIG. 10. In this arrangement the formations 9, 10 of the part handle portion 8 are in a plane perpendicular to the face of the bat and thus there will be improved shock absorbency compared to an arrangement where the formations 9, 10 are in a plane parallel to the face of the bat.

Figure 11:
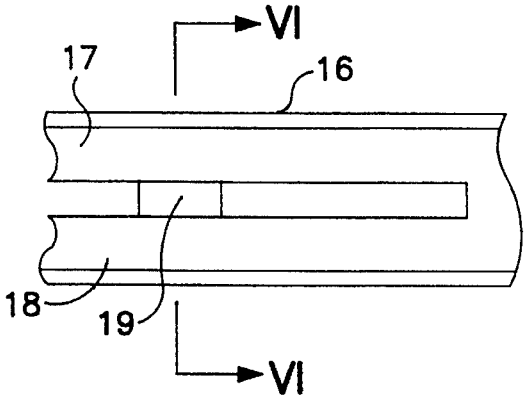
FIG. 11 is a side elevation of part of a handle portion with two fingers joined partly by a web according to a further embodiment of the present invention.
Figure 12:
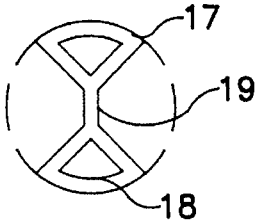
FIG. 12 is a sectional view along line VI—VI of FIG. 11.
Figure 13:
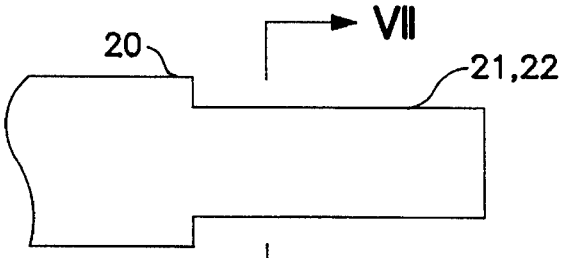
FIG. 13 is a side elevation of part of a striking portion with formations complementary to those of the part handle portion of FIG. 11.
Figure 14:
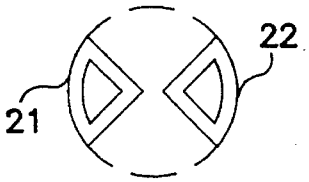
FIG. 14 is a sectional view along line VII—VII of FIG. 13.
Figure 15:
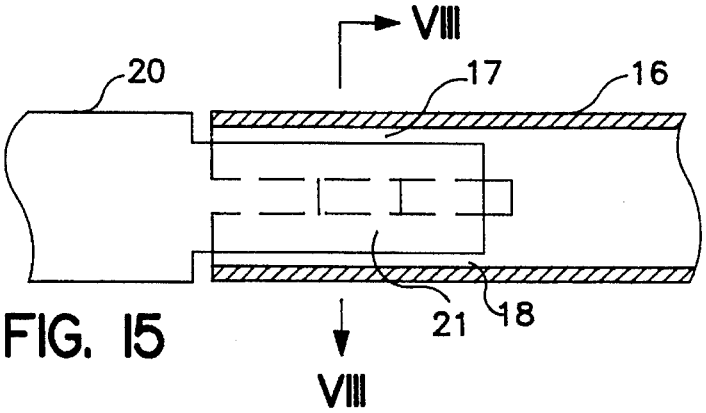
FIGS. 15 and 17 are side elevations of the part handle portion of FIG. 11 assembled with, and in FIG. 17 bonded to, the part striking portion of FIG. 13.
Figure 16:
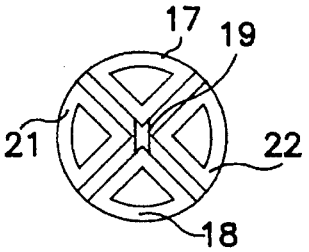
FIG. 16 is a sectional view along line VIII—VIII of FIG. 15.
Figure 17:
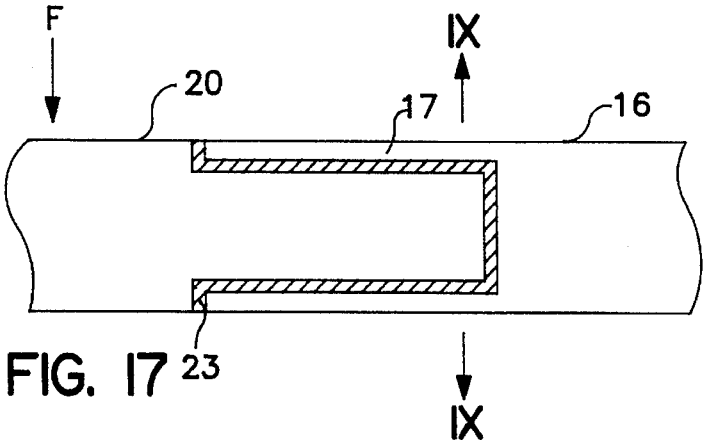
Figure 18:
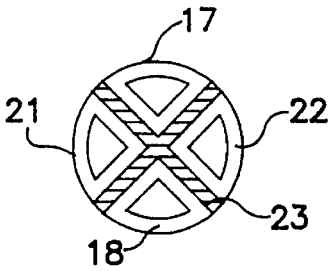
FIG. 18 is a sectional view along line IX—IX of FIG. 17.

Referring to FIG. 11 and 12, the part handle portion 16 has hollow fingers 17 and 18 joined along part of their length by an integral web 19. Referring to FIGS. 13 and 14, the part handle portion 20 has hollow fingers 21 and 22 (22 lies behind 21). The complementary formations (fingers) of the two part handle portions shown in FIGS. 11, 12, 13 and 14 are assembled so as to interdigitate as shown in FIG. 15. Vibration-damping material 23 is injected between the said formations and then set to bond to the formations as shown in FIGS. 17 and 18. The arrow F indicates the direction of the force which will be experienced by the striking implement, whether it be a cricket bat or tennis racket, during use. Thus the web 19 resists the opening of the fingers 17 and 18 which would otherwise occur during use of the striking implement.

What I claim is:

1. A striking implement comprises two structural parts in which a first part comprises a striking portion and a second part comprises a hollow handle portion, the said first and second parts each being provided with at least two hollow fingerlike formations which are complementary such that they can be assembled together in a longitudinal overlapping configuration and wherein said fingerlike formations are bonded inseparably together by a vibration-damping material interposed therebetween in substantially mutually perpendicular planes parallel to the longitudinal axis of the striking implement such that the vibration-damping material mechanically isolates the first part from the second part.

2. A striking implement according to claim 1 wherein the complementary formations each consist of at least two fingers which interdigitate when assembled.

3. A striking implement according to claim 1 or 2, in which the vibration-damping material is a thermosetting material.

4. A striking implement according to claim 1 or 2, in which the vibration-damping material is a thermoplastics material.

5. A striking implement according to claim 1, in which the vibration-damping material is an injectable material.

6. A striking implement according to claim 1, in which the vibration-damping material comprises an elastomer.

7. A striking implement according to claim 1, in which the vibration-damping material comprises a polyurethane.

8. A striking implement according to claim 1, in which the vibration-damping material has a hardness greater than 60° SHORE A measured according to B.S. 2782 Part 3 "Indentation Hardness by Durometer (Shore A)" and resilience below 20% when measured according to B.S. 903 Part A8 Method B "Method for Rebound Resilience".

9. A striking implement according to claim 8, in which the vibration-damping material has a hardness in the range 70° to 95° SHORE A measured according to B.S. 2782 Part 3 "Indentation Hardness by Durometer (Shore A)".

10. A striking implement according to claim 8 or 9, in which the vibration-damping material has a resilience in the range 5 to 15% measured according to B.S. 903 Part A8 Method B "Method for Rebound Resilience".

11. A striking implement comprises a two structural parts, in which a first part comprises a striking portion and a second part comprises a hollow handle portion, the said first and second parts each being provided with at least two hollow fingerlike formations which are complementary such that they can be assembled together in a longitudinal overlapping configuration and wherein said fingerlike formations are bonded inseparably together by a vibration-damping material interposed therebetween in substantially mutually perpendicular planes parallel to the longitudinal axis of the striking implement, such that the vibration-damping material mechanically isolates the first part from the second part and whereby the vibration-damping material comprises an injectable, thermoserring polyurethane elastomer which has a hardness of 70° to 95° SHORE A measured according to BS.2782 Part 3 "Indentation Hardness by Durometer (Shore A)" and a resilience in the range 5 to 15% measured according to B.S. 903 Part A8 method B "Method for Rebound Resilience".

12. A striking implement according to claim 1 or 11 in which the striking implement consists of two parts having complementary formations connected by means of vibration-damping material.

13. A striking implement according to claim 1 or 11 in which the vibration-damping material is self- bonded to the complementary formations without a separate adhesive.

14. A striking implement according to claim 1 or 11 wherein the complementary formations each consist of at least two fingers which interdigitate when assembled and one of the complementary formations of at least two fingers has a web connecting the fingers partially along the length thereof.

15. A striking implement according to claim 1, in which said vibration-damping material is interposed between and bonded to said formations in two substantially mutually perpendicular planes intersecting on the axis of symmetry of said assembled two parts.

16. A striking implement according to claim 1, in which at least one of said mutually perpendicular planes passes through the longitudinal axis of the implement.

* * * * *